US006024388A

United States Patent [19]

Tomah et al.

[11] Patent Number: 6,024,388

[45] Date of Patent: Feb. 15, 2000

[54] INSIDE TRUNK LOCK RELEASE WITH FOLDING ESCAPE SAW

[76] Inventors: Sabah H. Tomah; Edwina J. Svita, both of 1203 N. 11th Ave., Melrose Park, Ill. 60160

[21] Appl. No.: 09/138,921

[22] Filed: Aug. 24, 1998

Related U.S. Application Data

[60] Provisional application No. 60/060,809, Oct. 3, 1997.

[51] Int. Cl.[7] ..... E05C 3/06

[52] U.S. Cl. ..... 292/216; 292/DIG. 65

[58] Field of Search ..... 292/216, 336.3, 292/DIG. 65, DIG. 54

[56] References Cited

U.S. PATENT DOCUMENTS

| | | | |
|---|---|---|---|
| 2,105,735 | 1/1938 | Hodge . | |
| 3,100,122 | 8/1963 | Knapp . | |
| 3,992,909 | 11/1976 | McGhee . | |
| 4,080,812 | 3/1978 | Knott . | |
| 4,660,284 | 4/1987 | Decarolis | 30/157 |
| 5,054,826 | 10/1991 | Dow et al. . | |
| 5,445,326 | 8/1995 | Ferro | 292/336 |
| 5,859,479 | 1/1999 | David | 307/10.8 |

*Primary Examiner*—Darnell M. Boucher
*Assistant Examiner*—Gary Estremsky

[57] ABSTRACT

A steel wire (1) when pushed or pulled will release an emergency bar (2) with a saw blade (3) to untie whatever is bound. A steel bar (4) with a handle (5) that is attached to the detent lever (6), which will release the latch (7) to open the catch (8) in a straight line.

1 Claim, 4 Drawing Sheets

INSIDE TRUNK LOCK RELEASE WITH FOLDING ESCAPE SAW

This application claims priority from Provisional Application No. 60/060,809, filed Oct. 3, 1997.

BACKGROUND—FIELD OF THE INVENTION

In this day of age, safety is the utmost importance for all people in the world because of all the car jackings and kidnappings that are going on, it is almost impossible to be safe. Some people are being held hostage and are hidden in trunks to be transported from place to place. There is a need to be able to unlock the trunk from the inside and to be able to escape if bound.

BACKGROUND—DESCRIPTION OF PRIOR ART

The trunk lock, which is disclosed in U.S. Pat. No. 4,080,812 to Knott (1978) is an object of this invention. The character described being a key cylinder lock with a flat release arm, one end of which is formed to provide a hook portion, which is adapted to extend through slotted portion of the cylinder lock. Terminal of release arm is positioned in transversely cut away section to permit free rotation of the arm and has a flange adapted to bear against the body of the cylinder lock for maintaining the release arm in the proper position for use. The disadvantage of this invention is the fact that if bound a person, will not be able to apply said release.

Another patent of interest is U.S. Pat. No. 5,054,826 to Dow et al. (1991). According to this invention, the vehicle has a luggage compartment panel which carries a latch engageable with a striker mounted on the vehicle body which can only be activated with anything, but you, physically striking the trigger disabling the remote release. A hinge is interposed in the actuator member by which the operator may fold the actuator arm from proximity with a trigger release and move the actuator member without the releasing latch.

Referring to U.S. Pat. No. 3,992,909 to McGhee (1976), the SAFETY RELEASE OF AUTOMOBILE TRUNK is a form of a safety release, which is installed between a conventional key tumbler assembly and a trunk latch assembly. The key tumbler is usually mounted directly upon the outer panel of the deck lid. The latch is mounted upon an inner panel rotation of ring in the direction of the arrow, will then open the latch assembly. If unable to rotate ring, will not work.

Another U.S. Pat. No. 5,445,326 to Ferro et al. that can be noted is a release assembly that may be actuated by a person inside a trunk by releasing a flexible cable coupled to a detent lever within the latch pulled by a person to open the trunk or to release assembly by utilizing a spring loaded button but may not be able to actuate the button or pull the cable.

BRIEF DESCRIPTION OF THE DRAWINGS FIGURES

DETAILED DESCRIPTION OF THE INVENTION

With references to drawings FIGS. 1 through 7, the description of the INSIDE TRUNK LOCK RELEASE WITH FOLDING ESCAPE SAW will be detailed.

Figure 1:
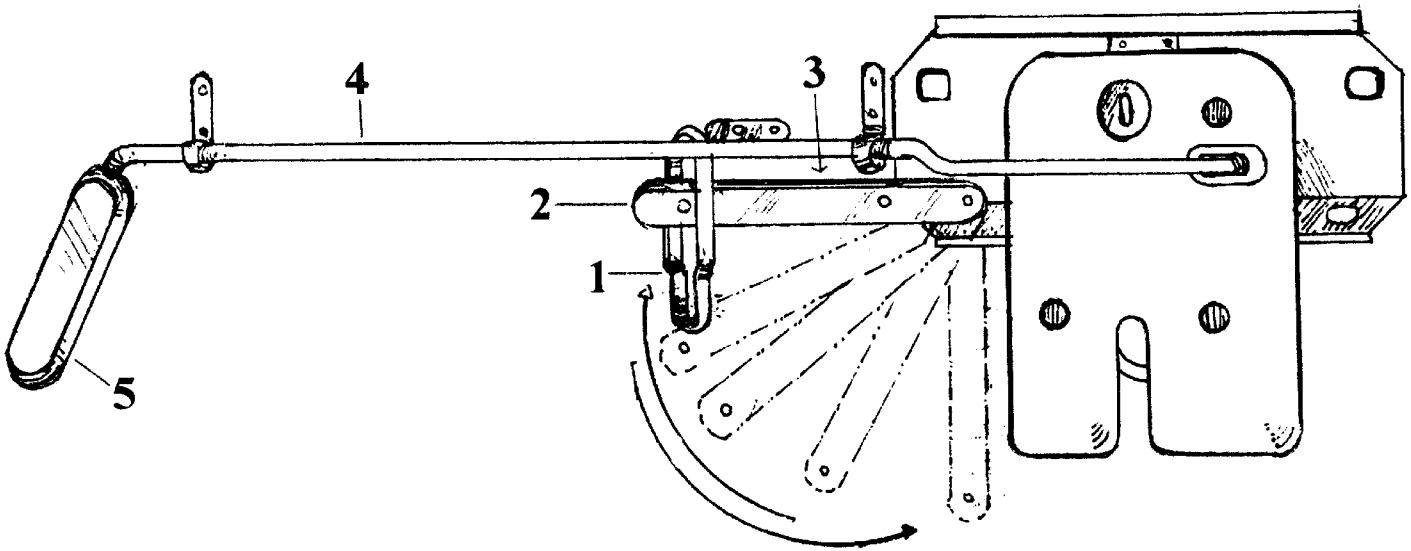
FIG. 1 shows a full side elevation view of the safety release installed as a part of a lid locking mechanism with front view of steel wire attachment.
Figure 1A:
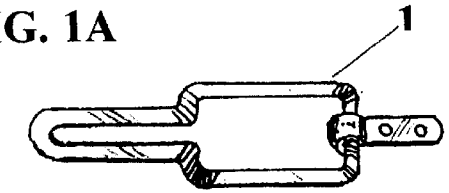
FIG. 1A shows the catch of FIG. 1.
Figure 2:
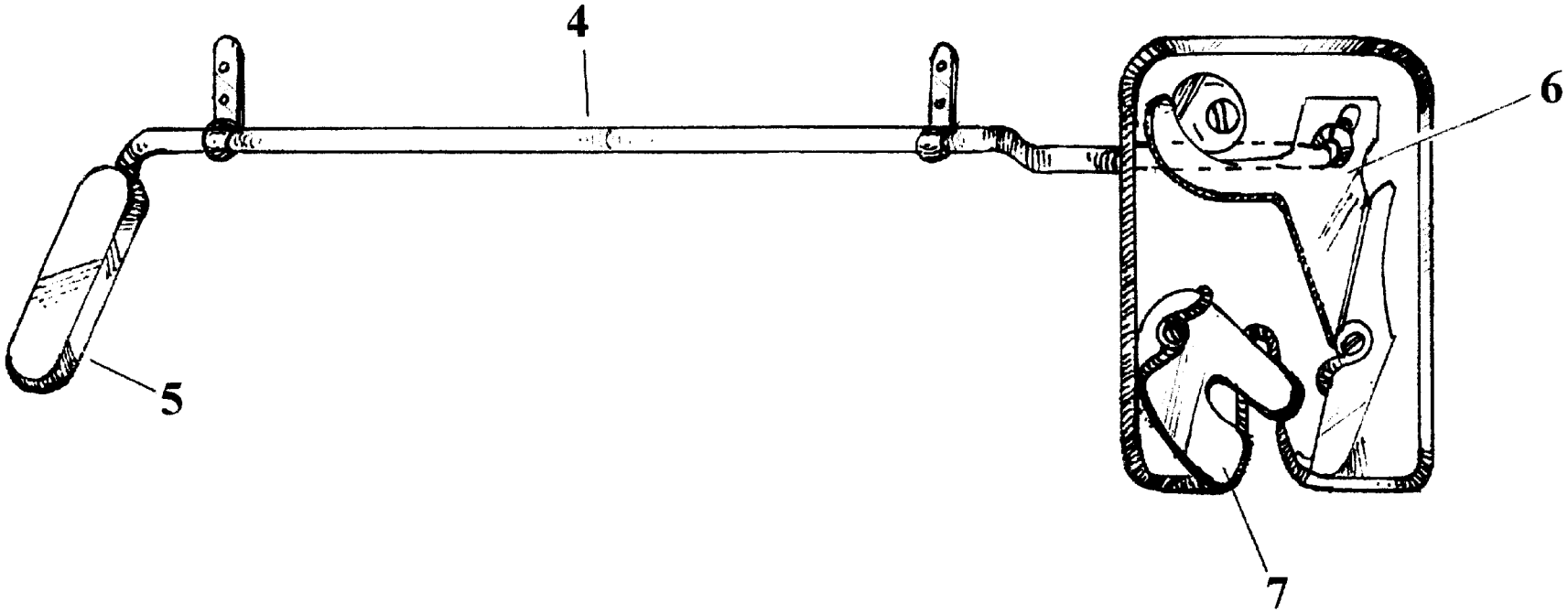
FIG. 2 shows a full side elevation view of steel wire with handle omitting steel wire emergency bar attachment and saw blade.
Figure 3:
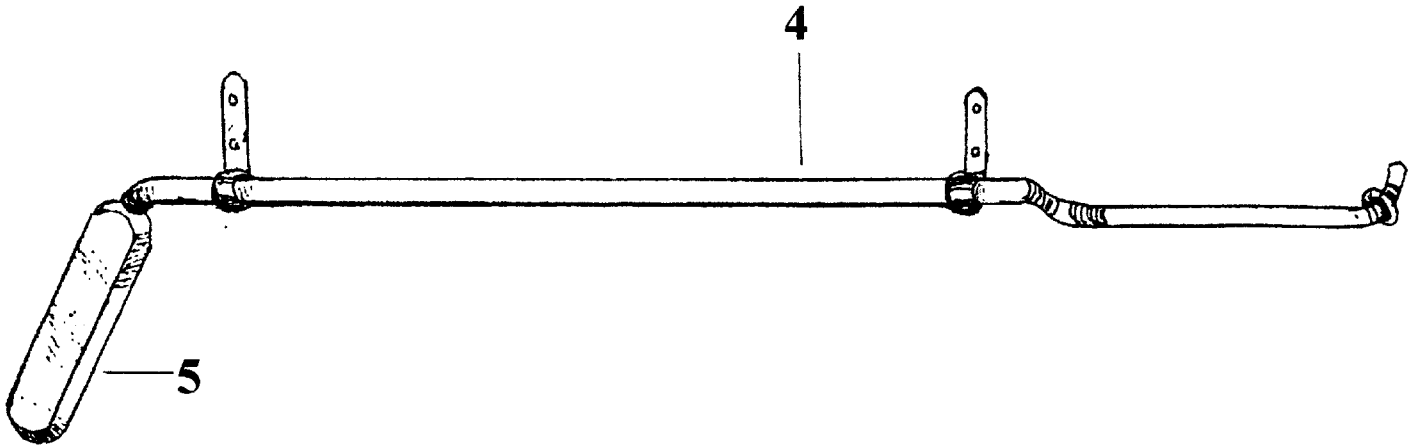
FIG. 3 shows steel bar with handle.
Figure 4:
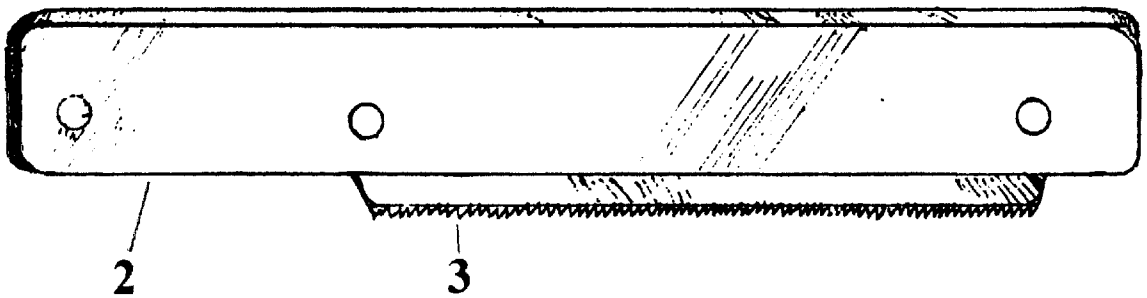
FIG. 4 shows emergency bar with saw blade.
Figure 5:
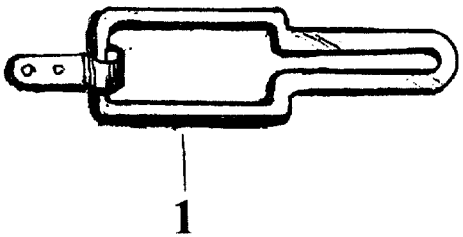
FIG. 5 shows steel with attaching bracket.
Figure 6:
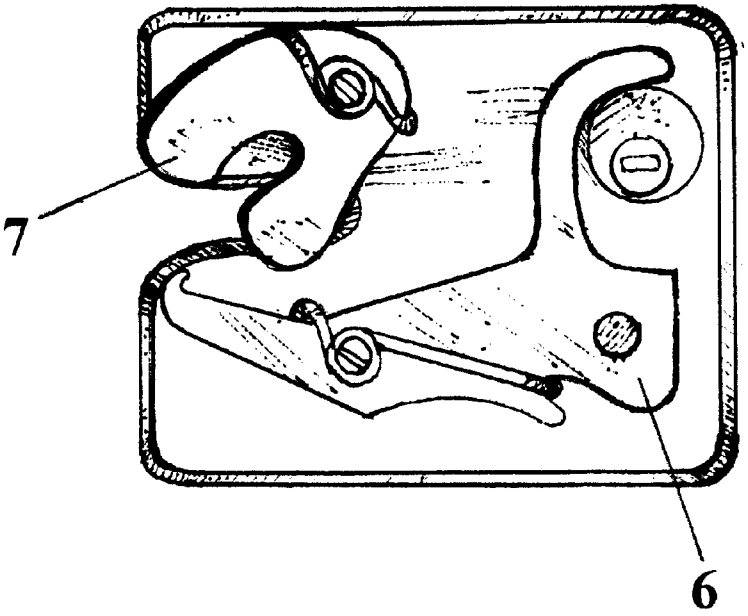
FIG. 6 shows detent lever and release latch.
Figure 7:
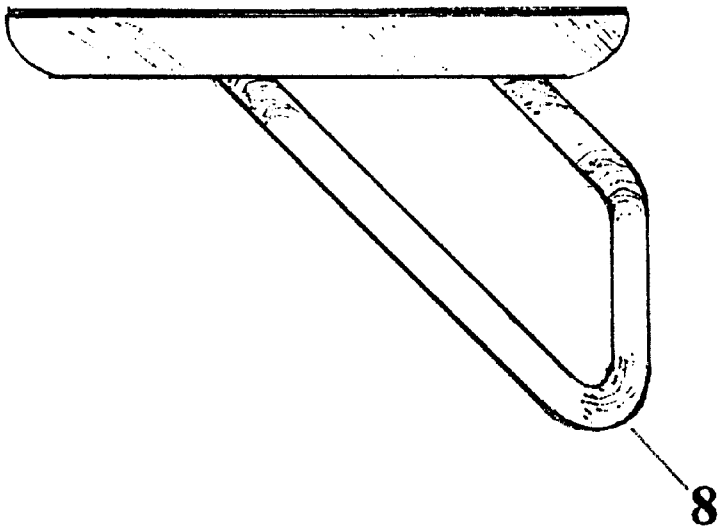
FIG. 7 shows catch.

The emergency trunk release, which may be mounted by conventional unillustrated fasteners to a trunk lid, is best illustrated in FIG. 1. A steel wire (1) is mounted by a riveted fastener, the steel wire (1) is aligned in a vertical position. The emergency bar (2) made of two bars with an escape saw blade (3) is aligned in a horizontal position until the steel wire (1) is pulled or pushed in a forward movement then the escape saw blade (3) pivots from a horizontal to a vertical position to be able to free the serrated side of the saw blade (3) which will cut or grind a person's building apart.

The steel bar (4) with a handle (5) is attached to the detent lever (6) when pulled or pushed forward will disengage the release assembly. The actuation of the detent lever (6) from either the exterior of the vehicle through the lock or from the interior of the trunk compartment through the release assembly may be accomplished. The steel bar (4) with handle (5) provides a means for a person locked within the trunk compartment to unlock and open the trunk lid from the inside. A means of escaping from car jackers, kidnappers, or other persons with criminal intent.

When the steel bar (4) and handle (5) disengage the detent lever (6) it releases the latch (7) that captures a portion of the catch (8) when engaged to the same. Upon capturing a portion of the catch (8) the latch (7) pivots into engagement with the detent lever (6) whereby the latch (7) assembly becomes securely coupled to the catch (8). The latch (7) assembly may be released from the catch (8) by a pivoting of the detent lever (6), which allows the latch (7) to release the catch (8) in FIG. 7.

We claim:

1. Device for allowing escape from a motor vehicle trunk, comprising:

a motor vehicle trunk latch having a housing;

a handle operably connected with the latch for allowing a person that is locked in the trunk to release the latch;

saw blade means for allowing a person bound in the trunk to cut their bindings, the saw blade means being pivotally mounted with respect to the housing, wherein the saw blade means is retained in a stored position by a catch that is adapted for mounting to the trunk and wherein release of the catch allows the saw blade means to pivot to an operable position for use.

* * * * *